US005816140A

United States Patent [19]

Hart

[11] Patent Number: 5,816,140

[45] Date of Patent: Oct. 6, 1998

[54] BALE WIRE TYING APPARATUS AND METHOD

[75] Inventor: Joseph H. Hart, Bakersfield, Calif.

[73] Assignee: Langston Companies, Inc., Memphis, Tenn.

[21] Appl. No.: 1,192

[22] Filed: Dec. 30, 1997

[51] Int. Cl.[6] ..... B65B 13/06; B65B 13/26

[52] U.S. Cl. ..... 100/3; 100/25; 100/34; 140/101; 289/1.5; 289/2

[58] Field of Search ..... 100/1–3, 8, 25, 100/33 R, 34; 24/27; 140/73, 101, 111, 114; 289/1.5, 2, 18.1

[56] References Cited

U.S. PATENT DOCUMENTS

| | | | |
|---|---|---|---|
| 3,168,912 | 2/1965 | Marcia | 140/101 |
| 3,477,363 | 11/1969 | Trumbo | 100/34 |
| 3,863,297 | 2/1975 | Simich | 100/34 |
| 3,863,558 | 2/1975 | Trumbo | 100/34 |
| 4,055,115 | 10/1977 | Simich et al. | 100/34 |
| 4,147,188 | 4/1979 | Simich | 140/101 |
| 4,353,295 | 10/1982 | Kandarian | 100/8 |
| 4,484,518 | 11/1984 | Jaenson | 100/34 |
| 5,644,978 | 7/1997 | Jaenson et al. | 100/34 |

*Primary Examiner*—Stephen F. Gerrity
*Attorney, Agent, or Firm*—Bacon & Thomas, PLLC

[57] ABSTRACT

A bale wire tying apparatus is provided to be used in conjunction with a baling press for tying looped ends of lengths of bale wire together around a compressed bale. The bale wire tying apparatus is formed by an elongated generally U-shaped channel member. The channel member generally includes an open wire releasing slot and a knot release opening which may be closed off by a knot release door. A loop securing element and various inner sloped wire loop guide surfaces are provided for guiding the looped ends into tying engagement. Methods for tying pre-formed looped ends of lengths of bale wire using such a bale wire tying apparatus are also provided.

10 Claims, 6 Drawing Sheets

28,30
36
22
34
64
52
60
26
56
42
24
58
26
50
54
62
22
22

22
26
24
22

22
26
24
22

22
26
24
22

22
26
24
22

22
26
24
22

BALE WIRE TYING APPARATUS AND METHOD

BACKGROUND OF THE INVENTION

1. Field of The Invention

The present invention relates to an apparatus which is used in combination with a conventional baling press. More particularly, the invention relates to an apparatus and method of tying pre-formed looped ends of lengths of bale wire in a baling press.

2. Description of the Related Art

It is well known in the art to tie looped ends of a wire together. For example, U.S. Pat. No. 3,168,912 and U.S. Pat. No. 4,147,188 disclose arrangements and methods for tying looped ends of wire together. The '188 patent specifically discloses a bale-tie wire for use with press platens in a baling press. U.S. Pat. No. 4,147,188 is therefore incorporated by reference in its entirety.

It is also well known in the art to use such looped end wire arrangements and tying methods in combination with a baling press. U.S. Pat. No. 3,477,363 and U.S. Pat. No. 3,863,558 disclose wire tying devices which are used in combination with a baling press to tie looped ends of a bale wire around a bale.

The baling press includes an upper platen and a lower platen which are arranged to compress and hold a bale via a hydraulic cylinder. A series of wire tying devices are aligned longitudinally and side-by-side in between the upper platen and the top of the bale. A corresponding series of open channels are aligned longitudinally and side-by-side underneath the bale and above the lower platen.

A plurality of lengths of bale wire having pre-formed looped ends are tied around the bale in the following manner as disclosed in the '558 patent. A first looped end of a length of bale wire having a bent loop portion extending downward is inserted into a first end of a guide channel defined by the wire tying device. The first looped end is advanced in the channel until it is secured in a notch located on a dump door near a second end of the channel. The length of bale wire is then fed through the open channel located beneath the bale.

A second looped end of the length of bale wire having a bent looped portion extending upward is positioned so that it can be inserted into the second end of the channel defined by the wire tying device. However, in order to properly position the second looped end for insertion into the wire tying device to allow the looped ends to be tied together, the bale wire must be bent near the second looped end so that the second looped end may enter the channel of the wire tying device in substantially straight manner. This bending that is required for proper positioning of the second looped end is very disadvantageous. A worker inserting the second looped must manually bend the bale wire. Since multiple lengths of bale wire are used to tie a single bale, a worker must perform this manual bending of the bale wire repeatedly for a single bale. Thus, the known method and apparatus are very labor-intensive. Prior art methods and devices do not provided a simple way for workers to quickly tie bale wire around a bale.

Another disadvantage with the prior art is that since the bending force must be applied repeatedly by the worker, the worker may be subjected to the risk of repetitive motion injury.

It is known in the art to use a curved chute alongside one end of the platens to allow a single worker to work from one side only of the platens. However, because of the orientation of the bent loop portions, such a chute can only be use with bale wire that is flattened throughout its length. The orientation of the bent loop portions according to the prior art cause the bale wire to rotate in the chute and out of position if bale wire that is not flattened throughout its length is used. Thus, the prior art is limited to tying bale wire that is flattened throughout its length if a chute is to be used.

Therefore, a new wire tying apparatus and method is needed to avoid the disadvantages of the prior art.

SUMMARY OF THE INVENTION

The present invention provides an apparatus and a method for tying bale wire which require less labor and reduces the risk of injury. The present invention also provides an apparatus and a method for tying bale wire in conjunction with a curved chute which do not require that the bale wire be flattened throughout its length.

The present invention aims to eliminate the aforementioned disadvantages by providing a wire tying apparatus and a method which do not require the bale wire to be bent in order to insert the second looped end in a proper position for tying and which orient the bent loop portions so that any bale wire having appropriate pre-formed looped ends may be used when a curved chute is used.

In accordance with the invention, a bale wire tying apparatus is provided for guiding and tying longitudinally extending lengths of bale wire with preformed looped ends around a bale. The bale wire tying apparatus comprises an elongated generally U-shaped guide channel member which includes opposed channel ends, an interior bottom wall extending between said channel ends, opposed parallel side walls extending generally perpendicular to and coextensive with the bottom wall, and a top wall member extending from one of the side walls parallel to the bottom wall. The top wall member defines an open wire releasing slot extending along the length of the channel member between the channel ends.

The top wall member includes a knot release opening adjacent one of the channel ends. The knot release opening extends to the wire releasing slot and has longitudinal and transverse dimensions suitable for enabling passage therethrough of a knot portion of a knotted length of bale wire extending through the channel member between the bottom wall and the top wall member.

A knot release door is pivotally mounted on the channel member to swing into and out of an opening blocking position. The knot release door includes a first inner sloped wire loop guide surface which, when the knot release door is in the opening blocking position, extends generally parallel to the bottom wall. The first wire loop guide surface extends from and inner first wire loop guide surface end located adjacent the top wall member to an outer second wire loop guide surface end located adjacent the one channel end. The first wire loop guide surface diverges away from the bottom wall from an area adjacent the first wire looped guide surface end to the second wire loop guide surface end.

A loop securing element is provided on the bottom wall located opposite the first wire loop guide surface. The loop securing element includes an inwardly extending loop engaging abutment which extends generally perpendicular to the bottom wall.

The bale wire tying apparatus of the present invention may include a second inner sloped wire loop guide surface which extends from a position closely adjacent the abutment sloping towards and intersecting the bottom wall in a direction away from the one channel end. This is the case when the loop securing element comprises a protuberance extending towards the first wire loop guide surface.

The bale wire tying apparatus according to the present invention may also include a third inner sloped wire loop guide surface which is located adjacent the bottom wall at the one channel end and slopes away from the bottom wall in a direction away from the one channel end.

The top wall member may also include a fourth inner sloped wire loop guide surface adjacent the knot release opening. The fourth wire loop guide surface slopes away from the bottom wall in a direction towards the one channel end.

The present invention also contemplates a method of tying pre-formed looped ends of lengths of bale wire using such a bale wire tying apparatus. According to the method, a first looped end of a length of bale wire is advanced into the channel member from a first channel end with a bent loop portion of the first looped end extending towards the bottom wall. The first looped end is secured against reverse motion by engaging the bent loop portion with the securing element near a second channel end. A second looped end of the same length of bale wire is advanced into the channel member from the second channel end with a bent loop portion extending towards the first inner doped wire loop guide surface. The bale wire remains in a substantially unbent condition near the second looped end until the first and second looped ends are juxtaposed. The second looped end is first advanced towards the bottom wall adjacent the second channel end between the second channel end and the securing element. It is then further advanced with the bent portion engaging and moving along the first wire loop guide surface until the first and second looped ends are juxtaposed and intertwined. The second looped end is finally withdrawn in a direction towards the second channel end to knot the looped ends together. The upper platen and channel member or members are moved to release the bale wire and knotted looped ends through the wire releasing slot and knot release opening, respectively. This movement includes driving the knot release door towards a position away from the knot release opening by the knotted looped ends.

When a curved chute is used in conjunction with the present invention, both looped ends are advanced into the channel member from the second channel end with the second looped end being inserted first. The second looped end is advanced through the channel member with a bent loop portion extending away from the bottom wall and into the curved chute. It is then directed by the chute into and through the open channels. The second looped end is advanced towards the second channel end such that the first looped end with a bent loop portion extending towards the bottom wall is secured against further advancement by engagement with the securing element. The method is then completed, as discussed above, by advancing the second looped end into the channel member again from the second channel end, etc.

Other features and details of the present invention will be apparent upon review of the detailed description that follows and the appended drawings.

BRIEF DESCRIPTION OF THE DRAWINGS

In order to more fully explain the characteristics of the present invention, a preferred embodiment is described hereafter as an example and without limitation, reference being made to the attached drawings, in which.

DETAILED DESCRIPTION OF THE PREFERRED EMBODIMENT

Figures 1, 2, 3:
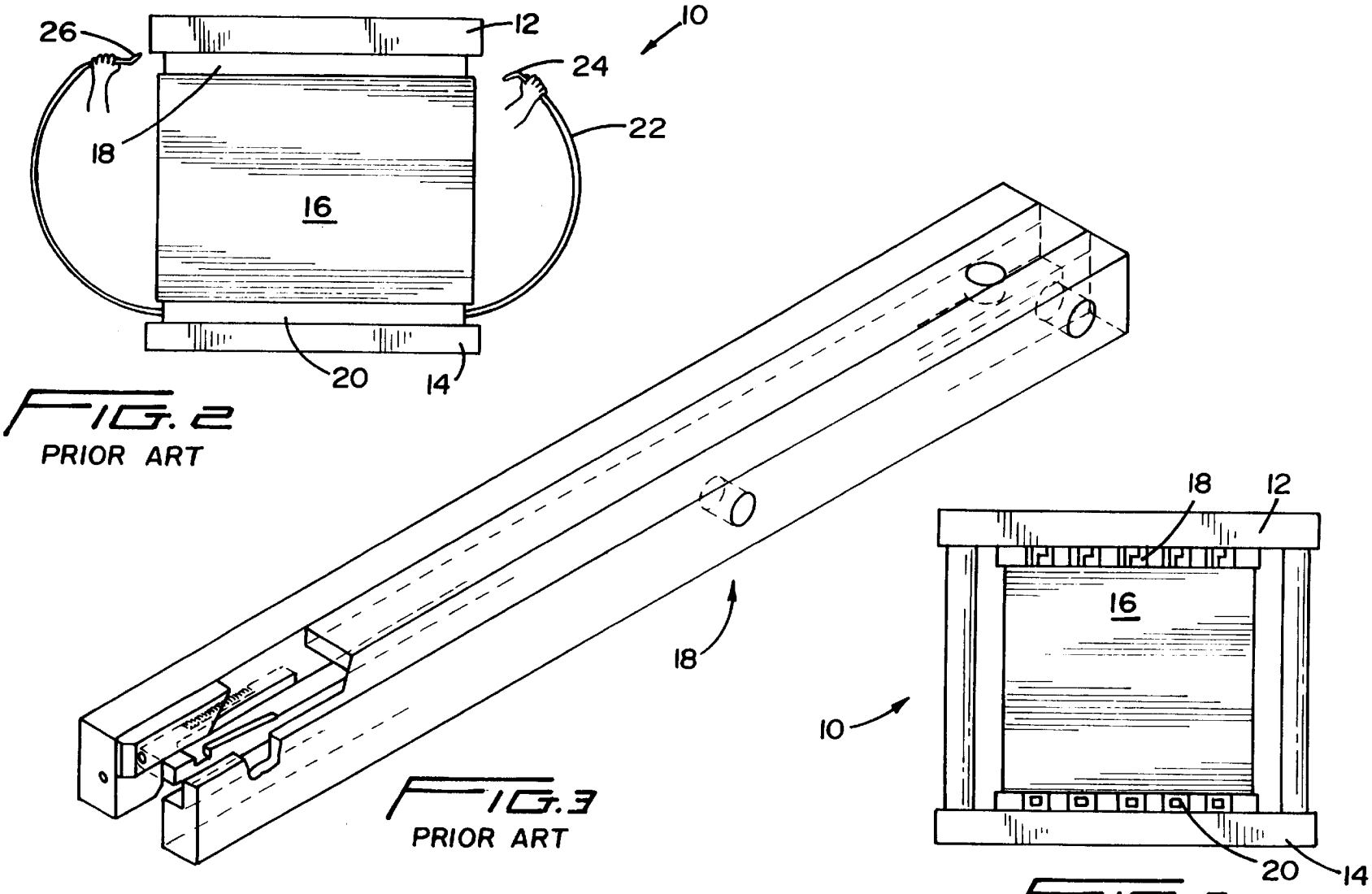
FIG. 1 PRIOR ART
FIG. 2 PRIOR ART
FIG. 3 PRIOR ART
FIG. 1 is an elevational view of a known baling press.
FIG. 2 is a side elevational view of a known baling press according to FIG. 1 and shows a known method for tying a length of bale wire with preformed looped ends around a bale.
FIG. 3 is a perspective view of a known wire tie device for use with a baling press according to FIGS. 1 and 2.
Figure 2A:
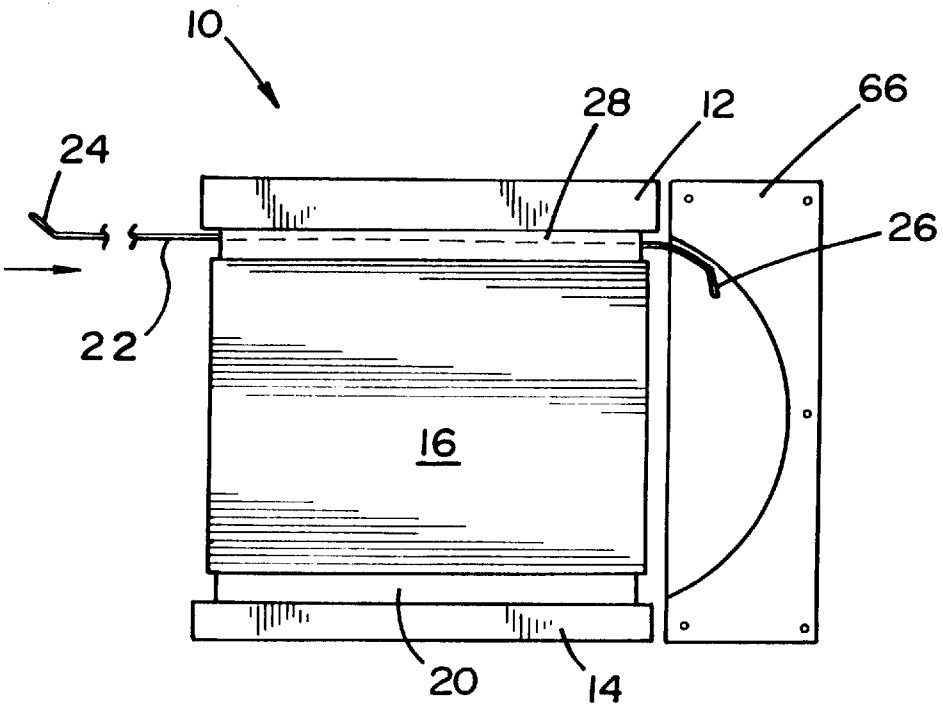
FIG. 2*a* is a side elevational view of a baling press and curved chute arrangement with a bale wire having a bent loop portion orientation according to the present invention.

As shown in FIGS. 1–2*a*, a baling press 10 has an upper platen 12 and a lower platen 14. A bale 16 is compressed and held between upper platen 12 and lower platen 14 using a hydraulic cylinder arrangement or the equivalent, which is not shown in the FIGURES. Baling press 10 is used in combination with a series of wire tying devices 18 and corresponding open channels 20 which are positioned between bale 16 and platens 12, 14. A curved chute 66 may also be positioned alongside baling press 10 as shown in FIG. 2*a* to enable operation by a single operator.

As shown in FIG. 2, longitudinally extending length of bale wire 22 having a first looped end 24 and a second looped end 26 is to be tied around bale 16. A known wire tying device 18 is situated beneath upper platen 12. First looped end 24 having a downwardly bent portion is inserted in a substantially straight manner into wire tying device 18 where a securing means secures first looped end 24 from being pulled back out of wire tying device 18. Bale wire 22 is then looped around bale 16 through open channels 20 located between bale 16 and lower platen 14. Bale wire 22 is then bent near second looped end 26 having an upwardly bent portion such that second looped end 26 may be inserted into wire tying device 18 in a substantially straight manner. An illustrative example of a known wire tying device 18 is shown in FIG. 3.

Figures 4, 5:
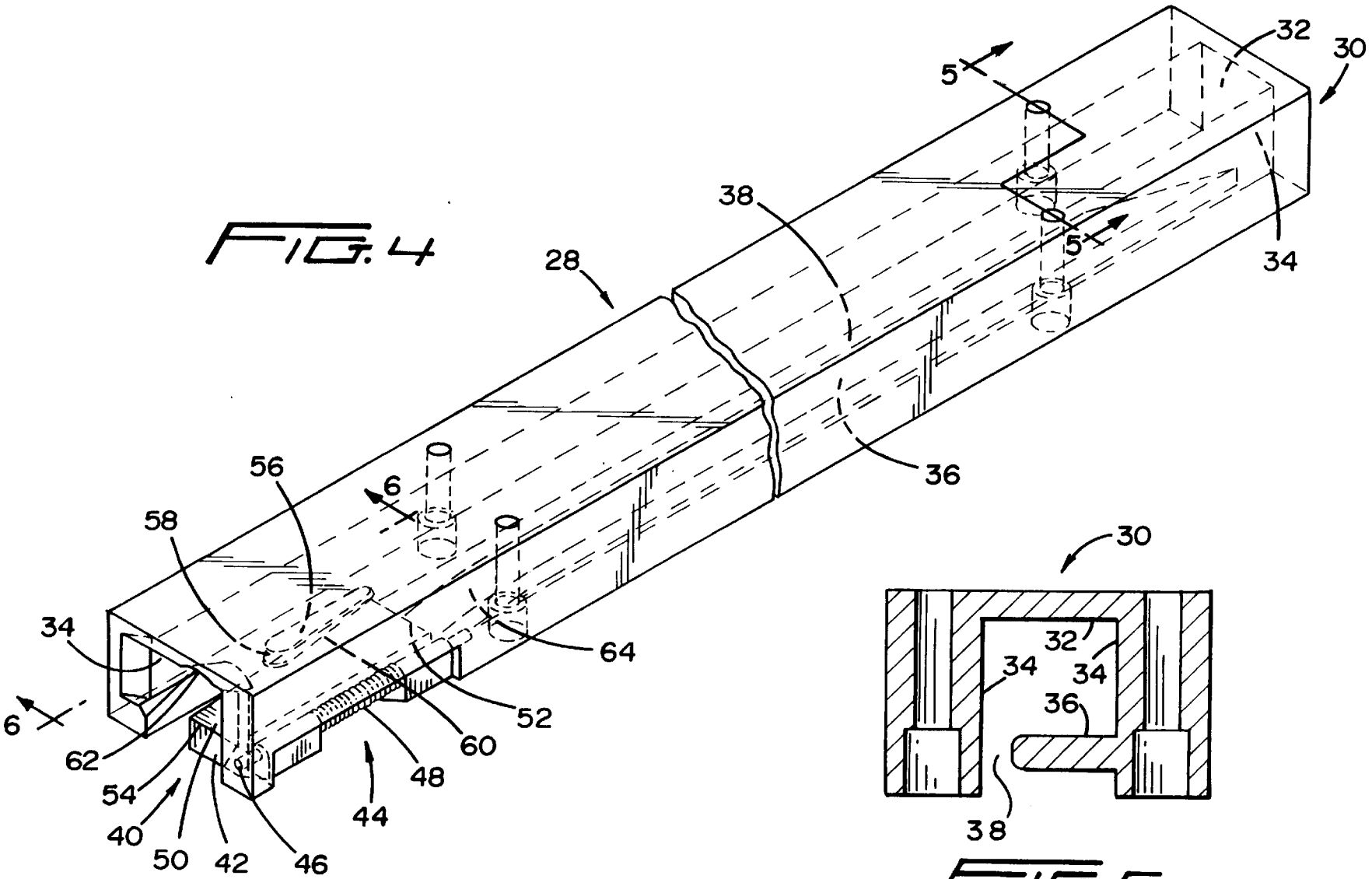
FIG. 4 is a perspective view of a bale wire tying apparatus according to the present invention for use with a baling press.
FIG. 5 is a sectional view as seen from section line V—V in FIG. 4.

A preferred embodiment of a bale wire tying apparatus 28 according to the present invention is shown in FIG. 4. Bale wire tying apparatus 28 comprises an elongated generally U-shaped guide channel member 30 having opposed ends. U-shaped guide channel member 30 comprises an interior bottom wall 32 from which opposed parallel side walls 34 extend generally perpendicularly. Opposed parallel side walls 34 are coextensive with interior bottom wall 32. A top wall member extends from one of the side walls 34 parallel to bottom wall 32 such that an open wire releasing slot 38 is defined to extend along the length of channel member 30 between the channel ends. A cross-section of channel member 30 is shown in FIG. 5.

Top wall member 36 includes a knot release opening 40 adjacent one end of channel member 30. Wire release opening 40 extends to wire releasing slot 38. The longitudinal and transverse dimensions of knot release opening 40 are suitable to allow a knot portion of a knotted length of bale wire to pass therethrough.

A knot release door 42 is pivotally mounted on channel member 30 to swing into an out of an opening blocking position whereby knot release opening 40 may be blocked. Knot release door 42 may completely span knot release opening 40 or form a narrow gap that corresponds with wire releasing slot 38 when knot release door 42 is in the opening blocking position.

In the embodiment shown in FIG. 4, one of the parallel side walls 34 is provided with a recess 44 in which knot release door 42 is mounted on a hinge pin 46. Hinge pin 46 preferably is situated on an axis extending longitudinally of channel member 30 and in a plane of the one of the side walls 34. A hinge spring 48 is mounted on hinge pin 46 such that knot release door 42 is biased into the opening blocking position. Of course, it is within the scope of the present invention that knot release door 42 may be pivotally mounted in any suitable manner as long as knot release door 42 moves into and out of the opening blocking position. For example, knot release door 42 may be pivotally mounted to the end of channel member 30 and may or may not be biased into the opening blocking position.

Knot release door 42 includes a first inner sloped wire loop guide surface 50 which, when knot release door 42 is in the opening blocking position, extends generally parallel to bottom wall 32. First wire loop guide surface 50 extends from an inner first wire loop guide surface end 52 located adjacent top wall member 36 to an outer second wire loop guide surface end 54 located adjacent the one end of channel member 30. First wire loop guide surface 50 diverges away from bottom wall 32 from an area adjacent first wire loop guide surface end 52 to second wire loop guide surface end 54.

A loop securing element 56 is located on bottom wall 32 opposite first wire loop guide surface 50. Securing element 56 extends toward first wire loop guide surface 50. Securing element 56 includes an inwardly extending loop engaging abutment 58 which extends generally perpendicular to bottom wall 32.

In the preferred embodiment shown in FIG. 4, loop securing element 56 is a protuberance. A second inner slopped wire looped guide surface 60 extends from a position closely adjacent abutment 58 towards and intersects bottom wall 32 in a direction away from the one end of channel member 30. Of course, it is within the scope of the present invention that other suitable securing elements may be used with or without second wire loop guide surface 60 and with or without extending towards first wire loop guide surface 50.

Preferably, loop securing element 56 extends inwardly approximately midway of the transverse width of first wire loop guide surface 50.

Figure 7:
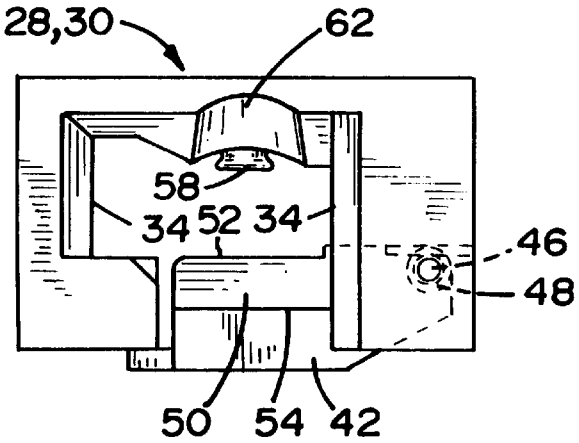
FIG. 7 is an end view as seen in FIG. 4.

In the preferred embodiment shown in FIG. 4, a third inner sloped wire loop guide surface 62 is located adjacent bottom wall 32 at the one end of channel member 30. Third wire loop guide surface 62 slopes away from bottom wall 32 in a direction away from the one end of channel member 30. Third wire loop guide surface 62 may also be shaped so as to help guide a looped end of a bale wire into proper position in channel member 30. For example, as may be best seen in FIG. 7, third wire loop guide surface 62 may be rounded.

Figure 6:
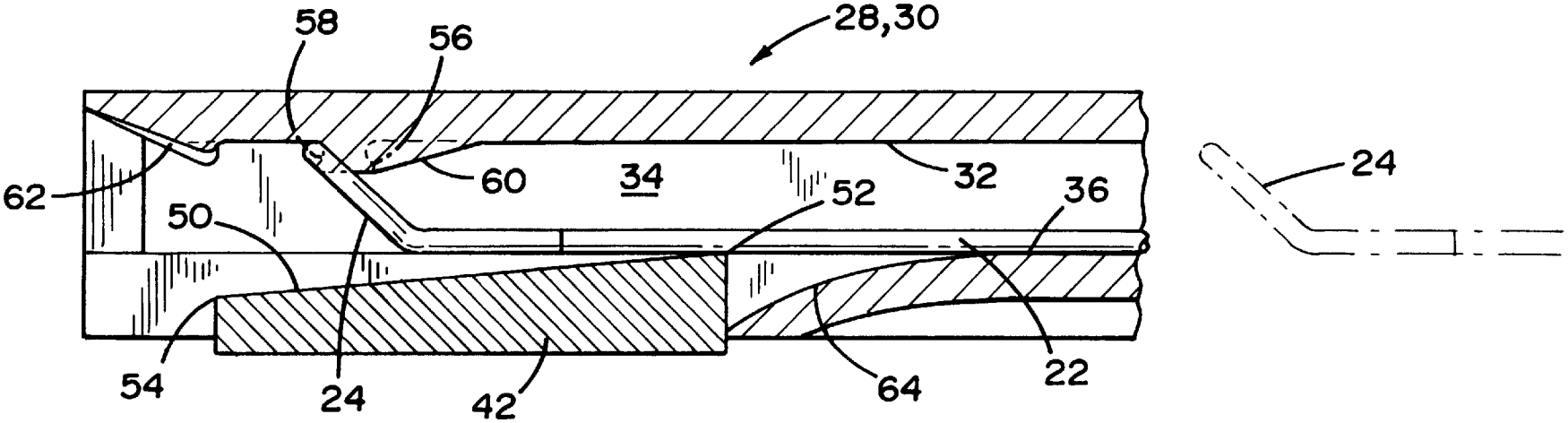
FIG. 6 is a sectional view as seen from section line VI—VI in FIG. 4 and shows the positioning of a first looped end of bale wire in solid and dashed lines.

As best seen in FIG. 6, a fourth inner sloped wire loop guide surface 64 may be provided as part of top wall member 36 adjacent knot release opening 40. Fourth wire loop guide surface 64 slopes away from bottom wall 32 in a direction toward the one end of channel member 30.

The use of the preferred embodiment of the present invention according to a preferred method of the present invention will be explained with reference to FIGS. 6, 8, 8*a*, 9 and 10*a* –*e*.

As shown in FIG. 6, first looped end 24 of bale wire 22 is advanced into channel member 30 from a position shown in dashed lines to a position shown in solid lines in which first looped end 24 is secured by loop securing element 56 against loop engaging abutment 58. In the preferred embodiment shown, first looped end 24 is advanced along second inner sloped wire loop guide surfaces 60 to secure it over securing element 56 which is formed as a protuberance.

It should be noted that the loop formed at first looped end 24 extends outward from the page and the bent portion is directed upward. A comparison with the prior art, as shown in FIG. 2, reveals that the orientation of first looped end 24 according to the present invention is opposite to the orientation of the corresponding looped end according to the prior art. Similarly, the orientation of second looped end 26 according to the present invention is opposite to the orientation of the corresponding looped end as shown by the prior art. Second looped end 26 is oriented with the loop extending away from the viewer and with the bent portion directed downward.

Figure 8:
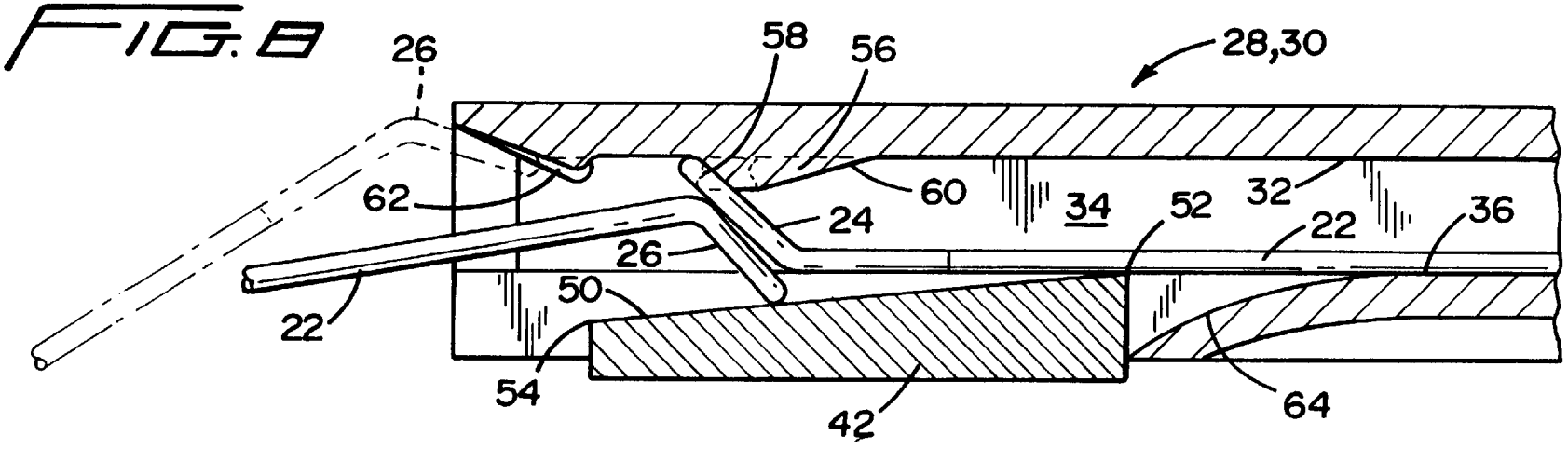
FIG. 8 is a sectional view according to FIG. 6 and shows the positioning of second looped end of bale wire in solid and dashed lines.

After bale wire 22 has been advance through open channel 20 and around bale 16, second looped end 26 is advanced to a position as shown in FIG. 8 by dashed lines. In this position, the downwardly bent portion of second looped end 26 contacts third wire loop guide surface 62. It should be noted that no bending of bale wire 22 beyond the naturally occurring curve formed in bale wire 22 by advancing it around bale 16 is required to position second looped end 26 against third wire loop guide surface 62 as shown.

As shown in FIG. 8, second looped end 26 is forced downward by third wire loop guide surface 62 into a position shown by solid lines such that second looped end 26 contacts first wire loop guide surface 50. Advancement of second looped end 26 into this position against first wire looped guide surface 50 also does not require bale wire 22 to be manually bent beyond the naturally occurring curve.

Figure 8A:
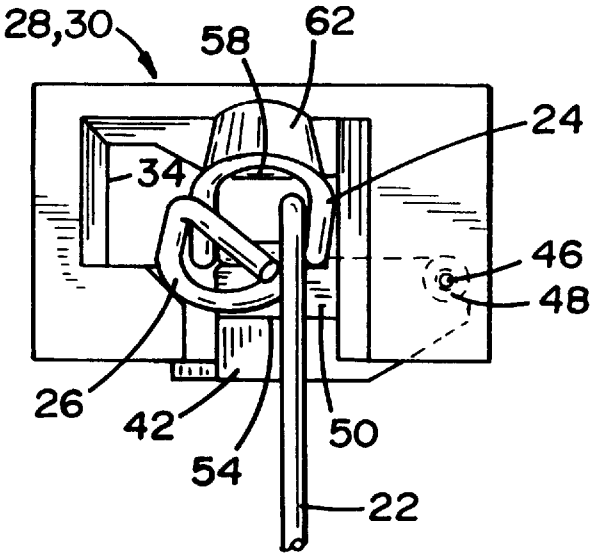
FIG. 8*a* is an end view according to FIG. 7 and shows the positioning of first and second looped ends as shown in solid lines in FIG. 8.

As shown in FIG. 8*a*, the loop formed on second looped end 26 is formed on the opposite side relative to the looped formed on first looped end 24. Also, second looped end 26 is advanced into channel member 30 such that it is transversely offset with respect to first looped end 24. It should be noted that when first looped end 24 is positioned in channel member 30 and secured by loop securing element 56, the portion of bale wire 22 extending from first looped end 24 is positioned directly above wire releasing slot 38.

Figures 9, 10A, 10B, 10C, 10D, 10E:
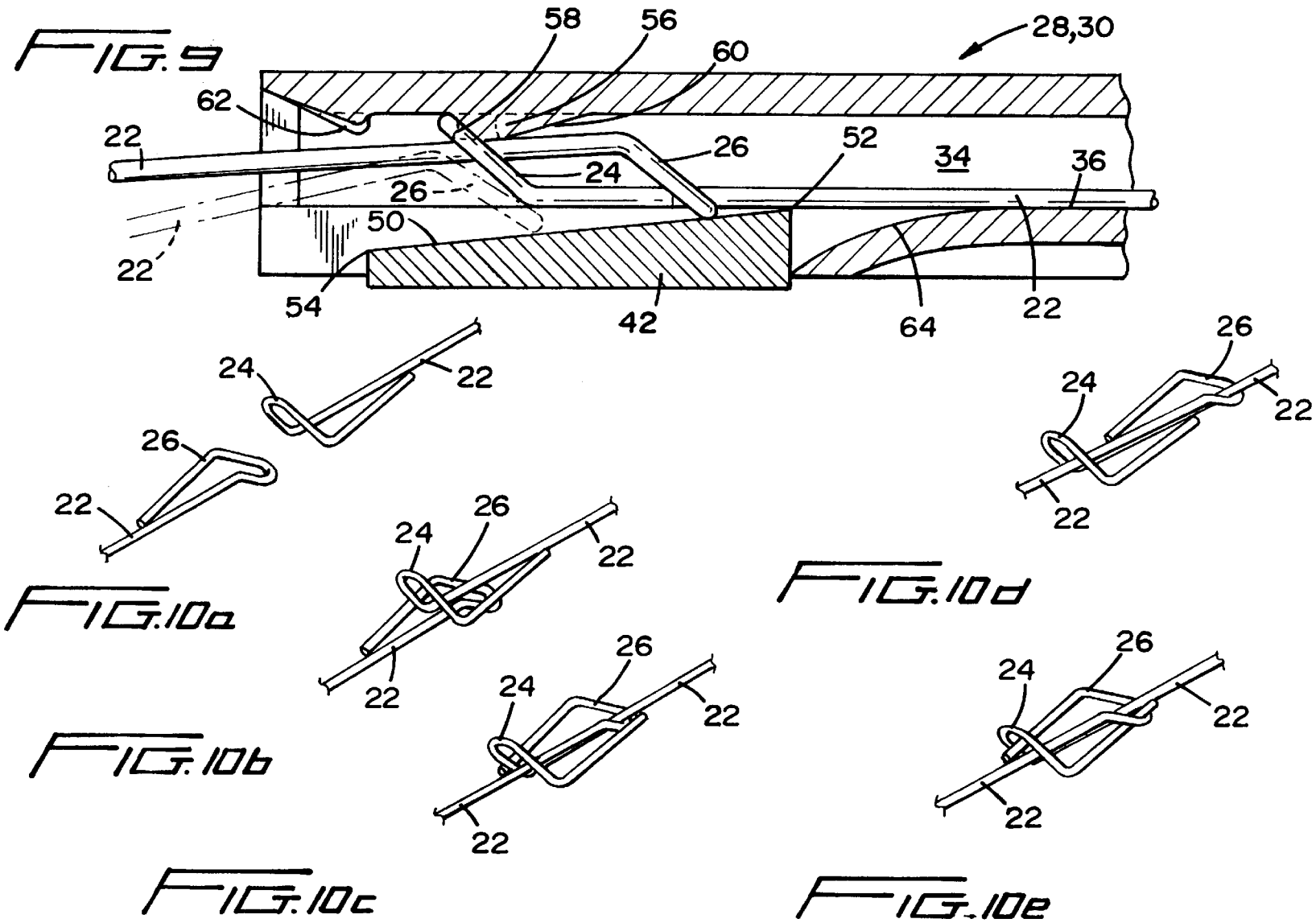
FIG. 9 is a sectional view according to FIG. 8 and shows a further positioning of the second looped end into engagement with the first looped end.
FIGS. 10*a*–10*e* show the relative positioning of the first and second looped ends as the second looped end is moved into tying engagement with the first looped end.

As shown in FIG. 9, as second looped end 26 is further advanced into channel member 30, first wire loop guide surface 50 forces second looped end 26 into tying engagement with first looped end 24. This tying engagement position is also represented in FIG. 10*d*.

FIGS. 10*a*–10*e* sequentially show first looped end 24 and second looped end 26 in various positions during the tying process.

FIG. 10*e* shows first looped end 24 and second looped end 26 knotted together which is accomplished by withdrawing second looped end 26 in a direction out of channel member 30 after second looped end 26 has been advanced into tying engagement with first looped end 24. Once first and second looped ends 24, 26 have been knotted together, the bale wire and the knotted portion thereof may be released from channel member 30 through the combination of knot release opening 40 and wire releasing slot 38 when knot release door 42 is moved from the opening blocking position. This may be accomplished by raising upper platen 12 and bale wire tying apparatus 28 above bale 16, which then extends to tighten the knotted wire loop.

When a curved chute 66 is used with bale press 10, as shown in FIG. 2*a*, the method of tying bale wire is as follows. Second looped end 26 of a length of bale wire 22 is advanced through a channel member 30 from the second channel end with the bent loop portion of second looped end 26 of a bale wire tie extending away from bottom wall 32. Second looped end 26 is advanced along curved chute 66 positioned alongside platens 12, 14 facing the opposite end of the first channel end so that second looped end 26 is directed into and through each open channels 20. Second looped end 26 is then advanced towards the second channel such that first looped end 24 with the bent loop portion extending towards bottom wall 32 is drawn into channel member 30 and secured against further advancement by engaging the bent loop portion of first looped end 24 with securing element 56. This method is completed, as with the previous method described above, by advancing second looped end 26 into channel member 30 from the second channel end, etc.

A preferred embodiment of the invention has been described above. However, it is to be understood that various modifications to the preferred embodiment could be made by any person skilled in the art without departing from the scope of the invention as defined in the claims that follow.

Moreover, it is to be understood that the use of the terms "bottom", "top", "side" in describing portions of the U-shaped glide channel are not intended to limit the orientation of the guide channel in any manner whatsoever, but rather are used in a relative sense to locate the various members relative to each other irrespective of the particular orientation of the U-shaped guide channel.

I claim:

1. A bale wire tying apparatus for guiding and tying longitudinally extending lengths of bale wire with pre-formed looped ends around a bale held between upper and lower platens of a baling press wherein the pre-formed loops are adapted to be knotted together by longitudinally moving one looped wire end relative to the opposite looped wire end after the ends have been juxtaposed from opposite directions, comprising:

an elongated generally U-shaped guide channel member including opposed channel ends, an interior bottom wall extending between said channel ends, opposed parallel side walls extending generally perpendicular to and coextensive with said bottom wall, and a top wall member extending from one of said side walls parallel to the bottom wall, said top wall member defining an open wire releasing slot extending along the length of said channel member between said channel ends;

said top wall member including a knot release opening adjacent one of said channel ends, said opening extending to said wire releasing slot and having longitudinal and transverse dimensions suitable for enabling passage therethrough of a knot portion of a knotted length of bale wire extending through said channel member between said bottom wall and said top wall member;

a knot release door including a first inner sloped wire loop guide surface and pivotally mounted on the channel member to swing into and out of an opening blocking position whereat said first wire loop guide surface extends generally parallel to said bottom wall, said first wire loop guide surface extending from an inner first wire loop guide surface end located adjacent said top wall member to an outer second wire loop guide surface end located adjacent said one channel end, and said first wire loop guide surface diverging away from said bottom wall from an area adjacent said first wire loop guide surface end to said second wire loop guide surface end;

a loop securing element on said bottom wall located opposite said first wire loop guide surface, said loop securing element including an inwardly extending loop engaging abutment extending generally perpendicular to said bottom wall.

2. A bale wire tying apparatus according to claim 1, wherein said knot release door is pivoted about an axis extending longitudinally of said channel member, and said axis lies in a plane that includes one of said side walls.

3. A bale wire tying apparatus according to claim 1, said element extending inwardly approximately mid-way of the transverse width of said first wire loop guide surface.

4. A bale wire tying apparatus according to claim 1, further comprising:

a second inner sloped wire loop guide surface extending from a position closely adjacent said abutment towards and intersecting said bottom wall in a direction away from said one channel end; and wherein said loop securing element comprises a protuberance extending towards said first wire loop guide surface.

5. A bale wire tying apparatus according to claim 4, including a third inner sloped wire loop guide surface located adjacent said bottom wall at said one channel end and sloping away from said bottom wall in a direction away from said one channel end.

6. A bale wire tying apparatus according to claim 5, said top wall member including a fourth inner sloped wire loop guide surface adjacent said knot release opening, said fourth wire loop guide surface sloping away from said bottom wall in a direction towards said one channel end.

7. A method of tying pre-formed, looped ends of lengths of bale wire in a baling press after opposed upper and lower platens of the baling press have compressed a material to be baled between the platens, wherein the looped ends of each length of bale wire include transversely bent portions and free wire ends lying adjacent the wire adjacent one side of the bent loop portions, the bent loop portions being bent in opposite directions out of the plane including the wire and the free ends lying on opposite sides of the wire, and wherein the looped ends are adapted to be knotted together by longitudinally moving one looped end of each length of bale wire relative to the opposite looped wire after the looped ends have been juxtaposed from opposite directions; the platens including parallel, generally U-shaped wire guide channel members and parallel open channels extending across the platens; each of the guide channel members including opposed first and second channel ends, an interior bottom wall extending between the channel ends, opposed parallel side walls extending generally perpendicular to and coextensive with the bottom wall, and a top wall member extending from one of the side walls parallel to the bottom wall, a top wall member defining an open wire releasing slot extending along the length of the channel member between the channel ends; the top wall member including a knot release opening adjacent the second channel end, the opening extending to the wire releasing slot and having longitudinal and transverse dimensions suitable for enabling passage therethrough of a knot portion of a knotted length of bale wire extending through the channel member between the bottom wall and the top wall member; a knot release door including a first inner sloped wire loop guide surface and pivotally mounted on the channel member to swing into and out of an opening blocking position whereat the first wire loop guide surface extends generally parallel to the bottom wall, the first wire loop guide surface extending from an inner first wire loop guide surface end located adjacent the top wall member to an outer second wire loop guide surface end located adjacent the second channel end, and the first wire loop guide surface diverging away from the bottom wall from an area adjacent the first wire loop guide surface end to the second wire loop guide surface end; a loop securing element formed by a protuberance on the bottom wall located opposite and extending towards the first wire loop guide surface, the element including an inwardly extending loop engaging abutment extending generally perpendicular to the bottom wall; a second inner sloped wire loop guide surface extending from a position closely adjacent the abutment towards and intersecting the bottom wall in a direction away from the one channel end; and a third inner sloped wire loop guide surface located adjacent the bottom wall at the one channel end and sloping away from the bottom wall in a direction away from the one channel end comprising, with respect to each channel member, the steps of:

advancing a first looped end of a length of bale wire into the channel member from the first channel end with the bent loop portion of the first looped end extending towards the bottom wall and securing the first looped end against reverse motion by engaging the bent loop portion with the securing element near the second channel end;

advancing a second looped end of the same length of bale wire into the channel member from the second channel end with the bent loop portion extending towards the first inner sloped wire loop guide surface and with the wire in a substantially unbent condition near the second looped end until the first and second looped ends are juxtaposed, the advancement being carried out by first advancing the second looped end towards the bottom wall adjacent the second channel end between the second channel end and the securing element, and then advancing the second looped end with the bent portion engaging and moving along the first wire loop guide surface until the first and second looped ends are juxtaposed and intertwined;

withdrawing the second looped end in a direction towards the second channel end to knot the looped ends together;

moving the upper platen and channel member to release the bale wire and knotted looped ends through the wire releasing slot and knot release opening, respectively, including driving the knot release door towards a position away from the knot release opening by the knotted looped ends.

8. The method according to claim 7, including engaging the third wire loop guide surface by the second looped end and advancing the second looped end along the third wire loop guide surface during the advancement of the second looped end before advancing the second looped end along the first wire loop guide surface.

9. A method of tying pre-formed, looped ends of lengths of bale wire in a baling press after opposed upper and lower platens of the baling press have compressed a material to be baled between the platens, the baling press having a curved chute positioned alongside the platens, wherein the looped ends of each length of bale wire include transversely bent portions and free wire ends lying adjacent the wire adjacent one side of the bent loop portions, the bent loop portions being bent in opposite directions out of the plane including the wire and the free ends lying on opposite sides of the wire, and wherein the looped ends are adapted to be knotted together by longitudinally moving one looped end of each length of bale wire relative to the opposite looped wire after the looped ends have been juxtaposed from opposite directions; the platens including parallel, generally U-shaped wire guide channel members and parallel open channels extending across the platens; each of the guide channel members including opposed first and second channel ends, an interior bottom wall extending between the channel ends, opposed parallel side walls extending generally perpendicular to and coextensive with the bottom wall, and a top wall member extending from one of the side walls parallel to the bottom wall, top wall member defining an open wire releasing slot extending along the length of the channel member between the channel ends; the top wall member including a knot release opening adjacent the second channel end, the opening extending to the wire releasing slot and having longitudinal and transverse dimensions suitable for enabling passage therethrough of a knot portion of a knotted length of bale wire extending through the channel member between the bottom wall and the top wall member; a knot release door including a first inner sloped wire loop guide surface and pivotally mounted on the channel member to swing into and out of an opening blocking position whereat the first wire loop guide surface extends generally parallel to the bottom wall, the first wire loop guide surface extending from an inner first wire loop guide surface end located adjacent the top wall member to an outer second wire loop guide surface end located adjacent the second channel end, and the first wire loop guide surface diverging away from the bottom wall from an area adjacent the first wire loop guide surface end to the second wire loop guide surface end; a loop securing element formed by a protuberance on the bottom wall located opposite and extending towards the first wire loop guide surface, the element including an inwardly extending loop engaging abutment extending generally perpendicular to the bottom wall; a second inner sloped wire loop guide surface extending from a position closely adjacent the abutment towards and intersecting the bottom wall in a direction away from the one channel end; and a third inner sloped wire loop guide surface located adjacent the bottom wall at the one channel end and sloping away from the bottom wall in a direction away from the one channel end comprising, with respect to each channel member, the steps of:

advancing a second looped end of a length of bale wire into and through the channel member from the second channel end with the bent loop portion of the second looped end extending away the bottom wall;

advancing the second looped end along the curved chute positioned alongside the platens facing the first channel end so that the second looped end is directed into and through the open channel;

advancing the second looped end towards the second channel end such that a first looped end of the same length of bale wire with a bent loop portion extending towards the bottom wall is drawn into the channel member and secured against further advancement by engaging the bent loop portion of the first looped end with the securing element near the second channel end;

advancing the second looped end into the channel member again from the second channel end with the bent loop portion extending towards the first inner sloped wire loop guide surface and with the wire in a substantially unbent condition near the second looped end until the first and second looped ends are juxtaposed, the advancement being carried out by first advancing the second looped end towards the bottom wall adjacent the second channel end between the second channel end and the securing element, and then advancing the second looped end with the bent portion engaging and moving along the first wire loop guide surface until the first and second looped ends are juxtaposed and intertwined;

withdrawing the second looped end in a direction towards the second channel end to knot the looped ends together;

moving upper platen and channel member to release the bale wire and knotted looped ends through the wire releasing slot and knot release opening, respectively, including driving the knot release door towards a position away from the knot release opening by the knotted looped ends.

10. The method according to claim 9, including, upon advancing the second looped end into the channel member again from the second channel end, engaging the third wire loop guide surface by the second looped end and advancing the second looped end along the third wire loop guide surface during the advancement of the second looped end before advancing the second looped end along the first wire loop guide surface.

* * * * *